US006089893A

United States Patent [19]

Yu et al.

[11] Patent Number: 6,089,893

[45] **Date of Patent: *Jul. 18, 2000**

[54] ILLUMINATED ELECTRICAL RECEPTACLE EMPLOYING ELECTROLUMINESCENT LAMP MEMBER

[75] Inventors: Dongxiao Yu, Commack, N.Y.; Joseph DiOrio, Providence, R.I.

[73] Assignee: Leviton Manufacturing Co., Inc., Little Neck, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,214

[22] Filed: Jan. 21, 1998

[51] Int. Cl.[7] ..... H01R 13/02

[52] U.S. Cl. ..... 439/225; 362/95

[58] Field of Search ..... 362/84, 95, 311; 439/910, 225, 103

[56] References Cited

U.S. PATENT DOCUMENTS

| | | | |
|---|---|---|---|
| 3,895,225 | 7/1975 | Prior | 362/95 |
| 5,117,334 | 5/1992 | Kameda | 362/84 |
| 5,586,879 | 12/1996 | Szpak | 362/293 |
| 5,660,459 | 8/1997 | Appelberg | 362/95 |
| 5,683,166 | 11/1997 | Lutzker | 362/84 |

*Primary Examiner*—Paula Bradley
*Assistant Examiner*—Briggitte Hammond
*Attorney, Agent, or Firm*—Paul J. Sutton

[57] ABSTRACT

An illuminated electrical receptacle which employs a lamp containing electroluminescent materials which are made to produce visible light upon the application of AC current to such materials. The lamp is flat with apertures which permit the blades of two electrical plugs to pass through from a face plate to a base containing electrical contacts. The face plate is formed of materials which permit the light produced to pass through all or selected parts of the face plate or outline the face plate or its apertures.

17 Claims, 3 Drawing Sheets

ILLUMINATED ELECTRICAL RECEPTACLE EMPLOYING ELECTROLUMINESCENT LAMP MEMBER

BACKGROUND OF THE INVENTION

1. Field of the Invention

The invention is directed to illuminated electrical receptacles and more particularly to one using a lamp consisting of electroluminescent material.

2. Description of the Prior Art

Prior art receptacles eliminate one of the possible duplex receptacle structures which can be housed in a standard outlet box and replace it with either an incandescent bulb or a neon bulb. The neon bulb produces very little light and the light produced is red resulting in poor illumination of adjacent structures. The incandescent lamp produces more light but also generates heat which can lead to the failure of the overall structure.

SUMMARY OF THE INVENTION

The instant invention overcomes the difficulties noted above with respect to prior art devices by providing a duplex receptacle which is illuminated by a lamp employing electroluminescent materials which provide a good light level and operate at a low thermal level. A base member contains the various female contacts to accept and make electrical contact with the blades of two electrical plugs inserted through appropriate apertures into the receptacle. The female contacts are connected to terminal screws which are connected to an AC power source and ground. A thin, flat lamp having electroluminescent material is activated by conductors passing through a special aperture in the base member to the AC power source. A series of apertures in the lamp, corresponding to the apertures in the base member in number and location permit the blades of two electrical plugs to pass therethrough. A face plate is placed over the lamp and it too contains apertures in number and position to be able to receive the blades of two electrical plugs. The face plate can be made of opaque material which results in edge lighting of the receptacle or it can be made of translucent material to provide an overall subtle illumination or of a transparent material to provide a high level of illumination. The face plate can also be provided with ribs, selected areas or windows to illuminate selected portions of the receptacle. It is therefore an object of the instant invention to provide an illuminated electrical receptacle.

It is an object of the instant invention to provide an illuminated receptacle which employs a lamp which provide s light by means of electroluminescence.

It is still another object of the instant invention to provide an illuminated receptacle employing a flat lamp which can be mounted between a face plate and a base and which provides apertures therein to permit the blades of electrical plugs to pass through such lamp.

It is yet another object of the instant invention to provide an illuminated receptacle employing a flat lamp which provides light by means of electroluminescence, which can be mounted between a face plate and a base and which provides apertures therein to permit the blades of electrical plugs to pass through such lamp.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
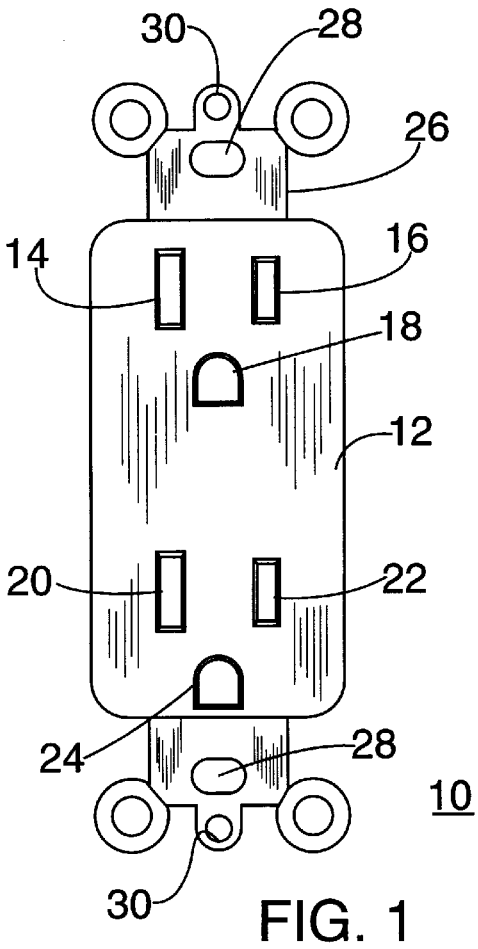
FIG. 1 is a front elevational view of an illuminated electrical receptacle constructed in accordance with the concepts of the invention.
Figure 2:
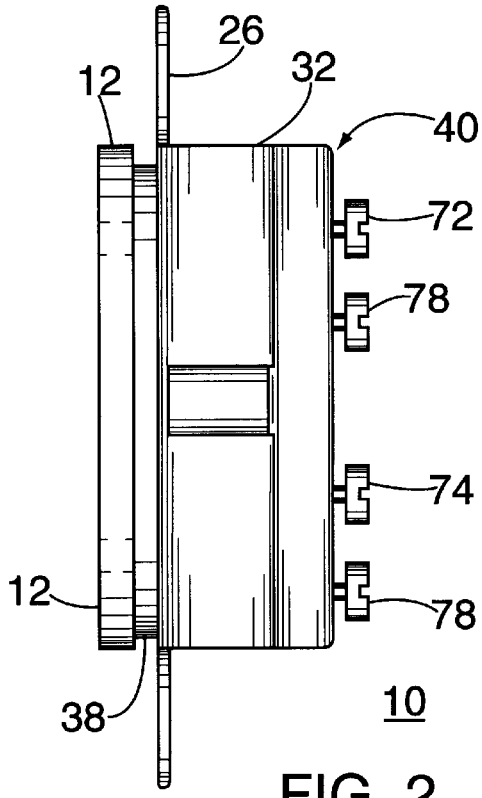
FIG. 2 is a side elevational view of the receptacle of FIG. 1.

Turning now to FIGS. 1 and 2 there is shown the external structure of the illuminated receptacle 10. A face plate 12 is arranged to receive two electrical plugs (not shown). Apertures 14, 16 and 18 are arranged to receive the neutral, phase and ground blades of a first electrical plug while apertures 20, 22 and 24 receive the neutral, phase and ground blades of a second electrical plug. Behind face plate 12 is lamp 38 which will be described in greater detail below. A mounting strap 26 having slots 28 permits the illuminated receptacle 10 to be mounted to the threaded mounting holes in the ears of a standard outlet box (not shown). Threaded apertures 30 permit a further face plate to be installed over the receptacle 10. Formed about the mounting strap 26 is spacer 32 with a front face 34 which contains apertures to permit the plug blades to pass through. Base member 40 is positioned within the substantially open rear face 36 of spacer 32 and seals the illuminated receptacle 10. A lamp 38 is placed between face plate 12 and the front face 34 of spacer 32.

Figure 3:
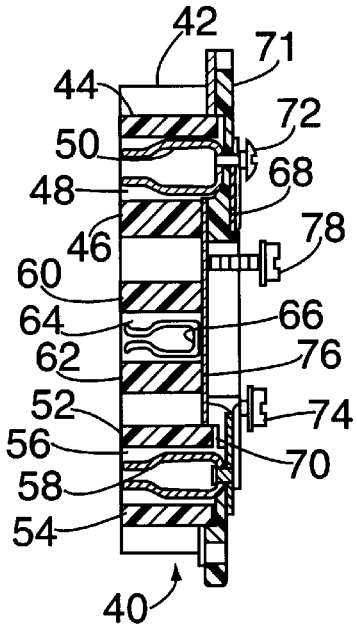
FIG. 3 is a top plan view, partly in section, of the base member portion of the receptacle of FIG. 1.

Base member 40 has a forward contact section 42 which contains a number of chambers defined by insulation barriers within which are placed the electrical contacts connected to the AC power source (not shown). As is best seen in FIG. 3, insulation barriers 44, 46 form a chamber 48 to house electrical contact 50. Similarly insulation barriers 52 and 54 provide chamber 56 in which electrical contact 58 is placed. Electrical contact 66 is placed in chamber 64 formed by insulation barriers 60 and 62. Metal plates 68, 70 may be placed on the rear surface 71 of base member 40 and connected to contacts 50 and 58, respectively. Terminal screws 72 and 74 permit connection of the individual conductors of the AC power source to the contacts 50 and 58. A metal plate 76 is placed within base member 40 is coupled to contact 66 and terminal screw 78. The arrangement of contacts, contact plates and terminal screws permit each contact to be tied to one of the phrase, neutral or ground conductors from the AC power source.

Figure 4:
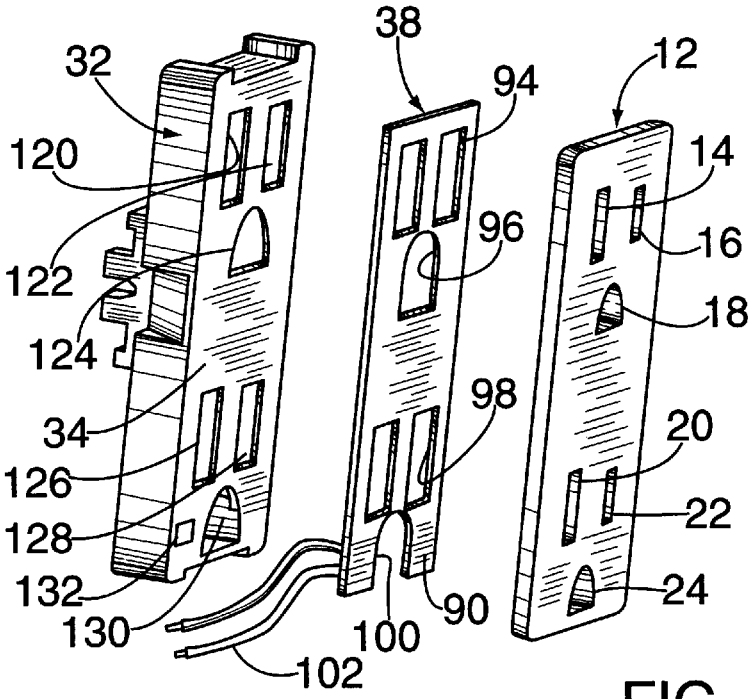
FIG. 4 is an exploded, front left perspective view of some of the components of the receptacle of FIG. 1.
Figure 5:
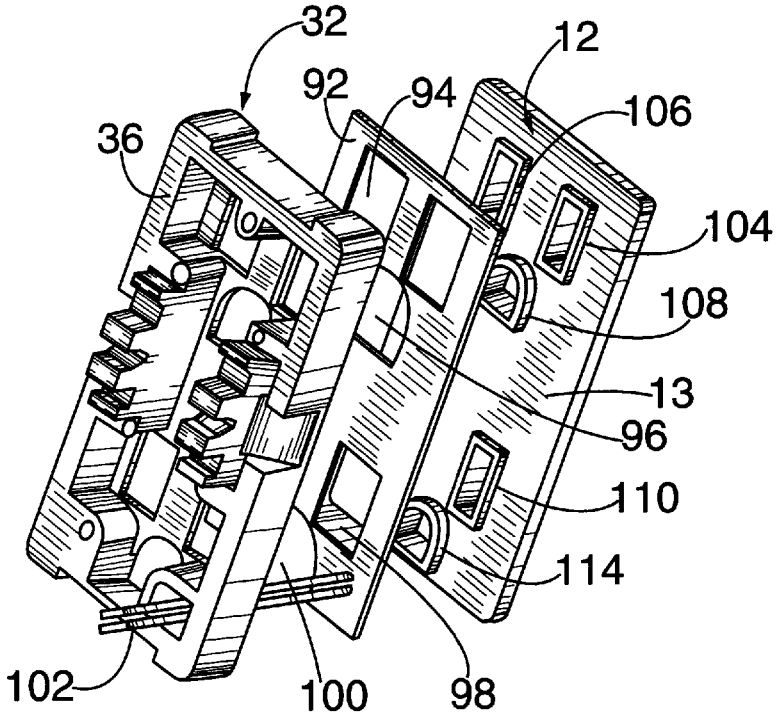
FIG. 5 is an exploded, rear right perspective view of the components of FIG. 4.

Turning now to FIGS. 4 and 5 there is shown face plate 12, lamp 38 and spacer 32. The base member 40 has been removed so that the details of the invention can be better appreciated. The face plate 12 shown is arranged to receive two three blade electrical plugs in aligned, stacked relationship called a duplex receptacle. Other face plate configurations can be used as with a single receptacle, with two side by side receptacles, for 15 amp service, for 20 amp service, power receptacles, etc. The apertures 14 and 20 are longer than apertures 16 and 22 to receive the plug blade connected to the neutral or white conductor. The apertures 16 and 22 receive the plug blade connected to the phase line or black conductor. Apertures 18 and 24 receive the plug blade connected to the ground conductor.

Figure 6:
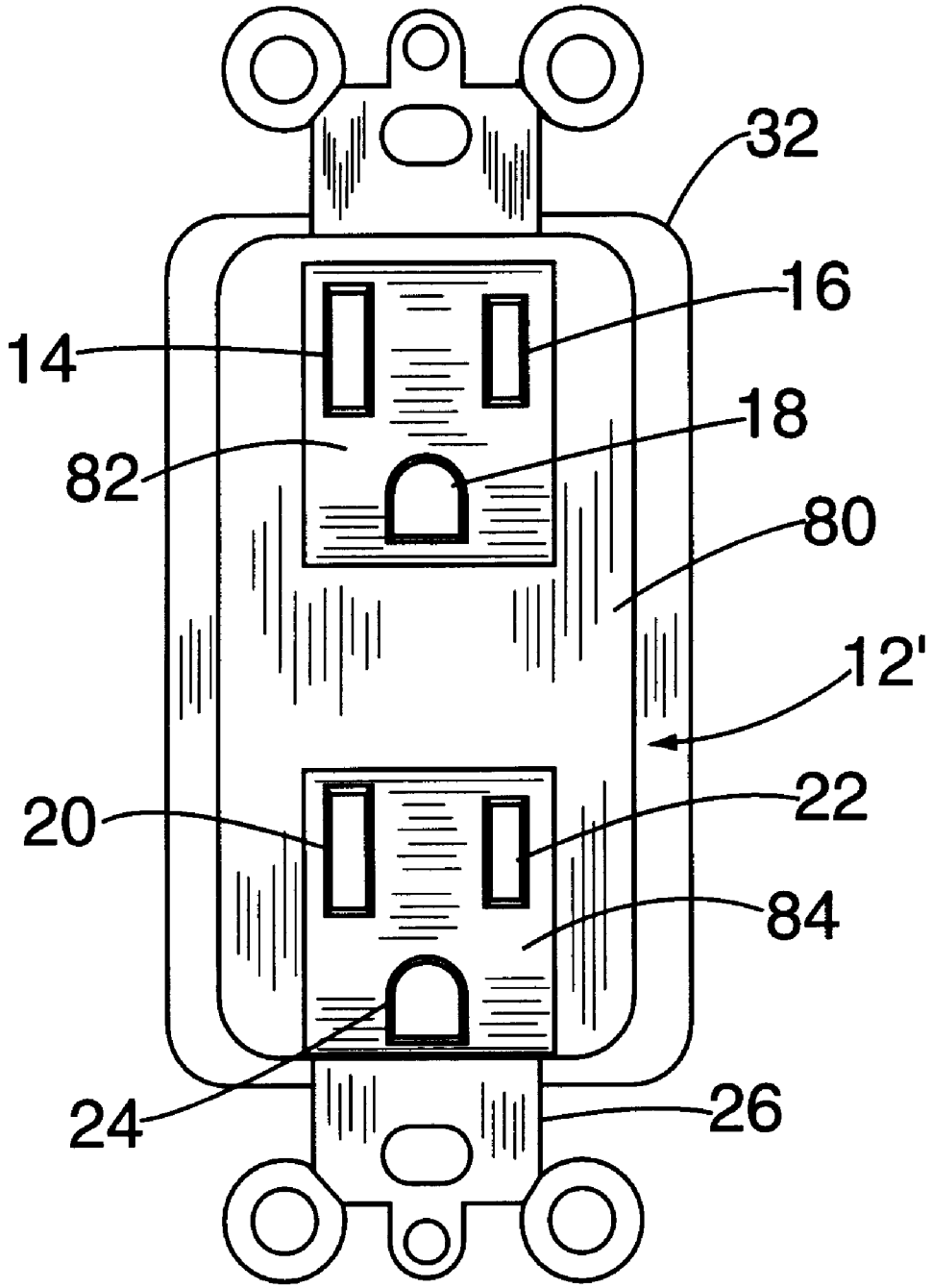
FIG. 6 is a front elevational view of a further embodiment of an illuminated receptacle constructed in accordance with the concepts of the invention.

The face plate 12 can be molded from different materials which will permit various levels of light to pass through. If the face plate 12 is made of opaque material, the light given off by lamp 38 will appear as edge lighting for face plate 12. The use of a translucent material will permit light to pass through face plate 12 depending upon the degree of translucence. This will provide an overall illumination at a low level. The face plate 12 can be formed of a transparent material to permit substantially all of the light produced by lamp 38 to pass through. If desired the face plate may be made of different materials at different locations as in face plate 12', as shown in FIG. 6. The main portion 80 of face plate 12' is made of either opaque or translucent material and it contains two windows 82, 84 of translucent or transparent material so that the areas about the apertures 14, 16 and 18 and 20, 22 and 24, respectively, are better illuminated that the main portion 80 of face plate 12'. The face plates 12 and 12' can be colored or tinted, if desired.

The bulb 38 is flat having a front face 90, a rear face 92 and two apertures 94 and a single aperture 96 for the blades of an electrical plug to pass through after insertion in apertures 14, 16 and 18. The two apertures 94 are of the same size. Two apertures 98, of the same size permit, blades inserted in apertures 20 and 22 of face plate 12, to pass through lamp 38. An aperture 100 with open bottom permits the blade inserted in aperture 24 in face plate 12 to pass through. The bulb 38 includes electroluminescent materials which when subjected to AC current emit visible light or infra-red light. Such materials can be zinc sulfide and may be combined with copper and/or magnesium. One source of zinc sulfide electroluminescent materials is Osram Sylvania. These materials may emit red, green, yellow, blue or orange colored light based upon the particular material employed. Two insulated electrical conductors 102 permit the bulb 38 to be connected to a source of AC power.

Translucent or transparent ribs 104, 106 and 108 are placed about the apertures 14, 16 and 18 on the rear face 13 of face plate 12. The ribs 104, 106 and 108 take the shape and size of apertures 94 and 96. When the front face 90 of bulb 38 is made to contact rear face 13 of face plate 12, the ribs 104 and 106 enter apertures 94 and rib 108 enters aperture 96 and provide edge lighting for apertures 14, 16 and 18 when no plug is present. Similarly, rib 110, and another like it, but not visible in FIG. 5 and rib 114 enter apertures 98 and 100, respectively, to provide edge lighting for apertures 20, 22 and 24 in the absence of a plug.

Spacer 32 has a front face 34 in which are located two apertures 120, 122 to receive the blades of a plug inserted through apertures 14 and 16, respectively, and an aperture 124 to receive the blade inserted through aperture 18 of face plate 12. Two apertures 126, 128 receive the blades of a plug inserted through apertures 20 and 22 and aperture 130 receives the blade inserted through aperture 24. An additional aperture 132 permits the conductors 102 of lamp 38 to pass into spacer 32 and be connected to a suitable terminal on base member 40.

It has been shown and described that an illuminated receptacle can be constructed to provide lighting for the receptacle without the loss of any of the functional parts. For example, the lighting is added to a duplex receptacle without the loss of one of the receptacle positions. The lighting is provided by a lamp containing electroluminescent material which is made to emit light in response to an AC current applied to the electroluminescent material. The lamp is flat and able to fit between a face plate and a base member and contains a number of apertures which permit the blades of inserted plugs to pass through the bulb and into contacts in the base member. The face plate or ribs about the apertures in the face plate can be made of various materials to control the amount and location of the illumination.

While there have been shown and described and pointed out the fundamental novel features of the invention are applied to the preferred embodiments, as are presently contemplated for carrying them out, it will be understood that various omissions and substitutions and changes of the form and details of the devices illustrated and in their operation may be made by those skilled in the art, without departing from the spirit of the invention.

We claim:

1. An illuminated electrical receptacle comprising:

a) a face plate member having a front and a rear surface with a plurality of first openings therein equal to a number of blades of electrical plugs to be inserted in said receptacle, extending from said front surface to said rear surface, each of said plurality of first openings arranged to receive therethrough only one blade of an electrical plug;

b) a base member having a front face and a rear face with plurality of second openings in said front face, said plurality of second openings equal in number to said plurality of first openings, each of said plurality of second openings in said base member front face aligned and communicating with a corresponding one of said plurality of first openings in said face plate member;

c) said base member having a plurality of electrical contact members, equal in number to said plurality of first openings, each aligned and communicating with a corresponding one of said plurality of first openings in said face plate member; and d) a lamp panel having a front surface and a rear surface positioned between said face plate member and said base member to illuminate said electrical receptacle;

e) said lamp panel has a plurality of third openings equal in number to said plurality of first openings, extending through said lamp panel from said front surface to said rear surface and aligned and communicating with a corresponding one of said plurality of first openings in said face plate member.

2. The illuminated electrical receptacle, as defined in claim 1, wherein said lamp panel is flat and said front surface of said lamp panel is positioned adjacent to said rear surface of said face plate member and said lamp panel rear surface is positioned with respect to said base member front face whereby each one of said blades of electrical plugs can pass through said aligned and communicating plurality of first openings in said face plate member, said plurality of third openings in said lamp panel and said plurality of second openings in said base member.

3. The illuminated electrical receptacle as defined in claim 1, wherein said lamp panel is flat and said front surface of said lamp panel is positioned adjacent said rear surface of said face plate member and said lamp panel rear surface is positioned in direct contact with said base member front face; and said lamp panel has a plurality of third openings, equal in number to said plurality of first openings, extending through said lamp panel from said front surface to said rear surface and aligned with and communicating with a corresponding one of said plurality of first openings of said face plate member whereby each one of said blades of electrical plugs can pass through said aligned and communicating plurality of first openings in said face plate member, said plurality of third openings in said lamp panel and said plurality of second openings in said base member.

4. The illuminated electrical receptacle, as defined in claim 3, wherein said electroluminescent material is zinc sulfide.

5. The illuminated electrical receptacle, as defined in claim 3, wherein said face plate member is made of a transparent material.

6. The illuminated electrical receptacle, as defined in claim 3, wherein said face plate member is made of a translucent material.

7. The illuminated electrical receptacle, as defined in claim 3, wherein said face plate member is made of an opaque material.

8. The Illuminated electrical receptacle as defined in claim 3, wherein said face plate member has transparent windows adjacent said plurality of first openings.

9. The Illuminated electrical receptacle as defined in claim 3, wherein said face plate member has transparent windows adjacent said plurality of first openings.

10. An illuminated electrical receptacle comprising:

a) a face plate member having a front surface and a rear surface with at least two openings therein extending from said front surface to said rear surface, each of said at least two openings arranged to receive therethrough one blade of an electrical plug;

b) a base member having a front face and a rear face with at least two openings in said front face, each of said at least two openings in said base member front face aligned and communicating with a corresponding one of said at least two openings in said face plate;

c) said base member having at least two electrical contact members, each aligned and communicating with a corresponding one of said at least two openings in said front face;

d) a lamp panel having a front surface and a rear surface positioned between said face plate member and said base member to illuminate said electrical receptacle;

e) said lamp panel has two electrical conductors extending from said rear surface and coupled to a terminal on said base member to permit said two electrical conductors to be connected to a source of AC power to light said lamp panel.

11. The illuminated electrical receptacle as defined in claim 10, wherein said lamp panel contains electroluminescent material which emits visible light when connected to a source of AC power.

12. The illuminated electrical receptacle, as defined in claim 11, wherein said electroluminescent material is zinc sulfide.

13. The illuminated electrical receptacle, as defined in claim 11, wherein said face plate member is made of a transparent material.

14. The illuminated electrical receptacle, as defined in claim 11, wherein said face plate member is made of a translucent material.

15. The illuminated electrical receptacle, as defined in claim 11, wherein said face plate member is made of an opaque material.

16. The illuminated electrical receptacle, as defined in claim 11, wherein said face plate member has transparent windows adjacent said at least two openings.

17. The illuminated electrical receptacle, as defined in claim 11, wherein said face plate member has translucent windows adjacent said at least two openings.

* * * * *